United States Patent [19]

Tsukioka

[11] Patent Number: 4,706,589

[45] Date of Patent: Nov. 17, 1987

[54] NEEDLE THREAD GUIDING APPARATUS

[75] Inventor: Takashi Tsukioka, Chofu, Japan

[73] Assignee: Tokyo Juki Industrial Co., Ltd., Chofu, Japan

[21] Appl. No.: 19,236

[22] Filed: Feb. 26, 1987

[30] Foreign Application Priority Data

Feb. 28, 1986 [JP] Japan ..... 61-28923[U]

[51] Int. Cl.[4] ..... B65H 57/00

[52] U.S. Cl. ..... 112/302; 112/261

[58] Field of Search ..... 112/302, 261, 270, 245

[56] References Cited

U.S. PATENT DOCUMENTS 2,541,549 2/1951 Sampson ..... 112/261

3,643,613 2/1972 Schwehm ..... 112/302

4,562,783 1/1986 McClellan ..... 112/261 X

*Primary Examiner*—H. Hampton Hunter

*Attorney, Agent, or Firm*—Morgan & Finnegan

[57] ABSTRACT

A needle thread guide provided at a needle bar frame and located adjacent to the needle entry protects the needle thread from being stuck by the needle when the workplace is fed during button holing. The guide guides the needle thread outwardly when the needle descends, thus the needle thread positioned lower than the needle eye is protected from being stuck by the needle. The guide is associated with the oscillating motion of the needle, but its direction of oscillation is opposite to the direction of needle oscillation, and its amplitude is almost twice the amplitude of the needle.

5 Claims, 13 Drawing Figures

NEEDLE THREAD GUIDING APPARATUS

BACKGROUND OF THE INVENTION

The invention relates to a button holing sewing machine. The invention relates more particularly to a needle thread guiding apparatus which guides the needle thread so that it is not stuck by the needle during the button holing process.

Referring now to FIGS. 4 and 7 of the drawings, a conventional button holing sewing machine is shown. A needle bar 1 holds a needle 2 at its lower end, it in turn is held by a needle bar frame 3 and can be moved up and down therefrom. The upper end of the needle bar frame 3 is pivoted by means of a hinge stud 5 affixed to the frame 4.

A guide block 7 is slidably inserted into a groove portion 6. The guide block 7 is pivoted by a pin which is projected from a rock arm 8.

The rock arm 8 is oscillated by the rock shaft which is connected to the needle oscillation mechanism located rear side of the sewing machine. The oscillation mechanism comprises a triangle cam inserted in a needle bar pitman. Such a mechanism is well known.

Thus the needle bar frame 3 oscillates around the hinge stud 5. To keep this oscillating motion more stable, a guide plate 9 is provided such that the needle bar frame 3 slides along the guide plate 9. The guide plate 9 is fixed to the machine frame 4. A presser foot 11 is connected to one end of a work clamp 12. Another end of this work clamp 12 is connected to a work-clamp-arm-slide-rod 13.

The work-clamp-arm-slide-rod 13 is slidably inserted into a support 14. An arm 15 is connected to the work-clamp-arm-slide-rod 13. A link 16 is connected to a feed-regulating-scale-arm 17 by a screw 18. The feed-regulating-scale-arm 17 is connected to a feed link 20 by means of a rotational shaft 19. The feed link 20 is rotatably connected to a roller 21*a* which is slidably inserted into a groove 21 provided at the bottom surface of a feed cam 50.

Incorporating the rocking motion of the rock arm 8, the needle bar 1 is oscillated as shown in arrow "A" (FIG. 4). The rotational motion of the groove 21 by the feed cam 50 causes the feed-regulating-scale-rod 17 to oscillate around the rotational shaft 19. Thus, the work-clamp-arm-slide-rod 13 slides along the shaft hole of the support 14 by means of the link 16 and the arm 15. Accordingly, the presser foot 11 moves in the direction shown in arrow "B" (FIG. 4) by means of the work clamp 12. Such a mechanism of the button holing sewing machine is well-known.

Under the conventional button holing sewing machine, described above, the needle bar frame 3, causes the needle 2 to oscillate, and the presser foot 11, which is connected to the work clamp 12, feeds the workpiece in the direction of "C" and "D" as shown in FIG. 5, and thus the staggered stitch line 23 is conducted and the button holing sewing machine completes one cycle of stitching.

FIGS. 6A, 6B, 8A and 8B of the drawings illustrate a conventional button holing sewing machine and the positional relationship between the direction of threading into the needle eye and the position of the operator.

A needle eye 2*a* is threaded by a needle thread 24 which has a portion of a needle thread 24*a* which is positioned above the needle eye 2*a*, and a portion of needle thread 24*b* which is positioned below the needle eye 2*a* and an operator's position M is shown in FIGS. 8A and 8B. Under such a positional relationship, as shown in FIGS. 8A, 8B and 5, when a workpiece 22 is fed in the direction of "D" (FIG. 8A), the needle thread portion 24*b* positioned below the needle eye 2*a* is positioned toward the operator's side in relation to the needle's position as shown in FIG. 6A and FIG. 8A.

By contrast, when the workpiece 22 is fed in the direction of "C" (FIG. 8B), the needle thread portion 24*b* positioned below the needle eye 2*a* is positioned partly toward the rear side of the needle and away from the operator's side as shown in FIGS. 6B and 8B. Therefore, it is possible that the needle 2 sticks the needle thread portion 24*b* when the needle 2 descends, thereby cutting the needle thread 24.

SUMMARY OF THE INVENTION

Hence with the foregoing in mind, it is a primary object of the present invention to provide a needle thread guide which guides a portion of a needle thread positioned below the needle eye outwardly.

It is a further object to provide an outwardly guiding motion which is associated with the up-down motion of the needle.

In order to implement these and other objects of the invention, which will become apparent as the description proceeds, the invention comprises a needle thread guide for guiding at least a portion of a needle thread which is positioned below a needle eye outwardly when the needle descends. This protects the needle thread from being stuck by the needle or from being interfered with by the needle. Thus, the stitch work is greatly improved from the viewpoint of its stitching quality.

BRIEF DESCRIPTION OF THE DRAWINGS

For a fuller understanding of the nature and objects of the invention, reference should be had to the following detailed description, taken in connection with the accompanying drawings in which.

DETAILED DESCRIPTION OF THE DRAWINGS

Figure 1:
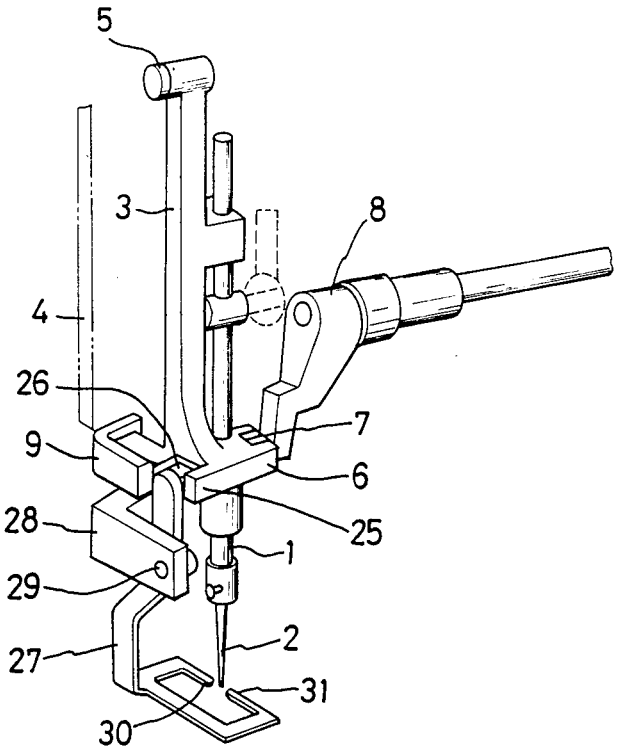
FIG. 1 is a perspective view of a needle guiding apparatus according to a preferred embodiment of the present invention.

Referring now to FIG. 1, one preferred embodime the invention will be explained. FIG. 1 illustrates a needle bar 1, a needle 2, a needle bar frame 3, a frame 4, a hinge stud 5, a guide-block-groove-portion 6, a guide block 7, a rock arm 8, and a guide plate 9.

These parts were described in the aforementioned conventional button holing apparatus and therefore no further explanation is necessary.

According to the invention, an additional guide-block-groove-portion 25 is provided at the opposite side of the guide-block-groove-portion 6. Another guide block 26 is slidably inserted into this guide-block-groove-portion 6. The upper end of a guide plate 27 is pivotally connected to the guide block 26. The middle portion of the guide plate 27 is pivotally connected to a fixing plate 28 by a step screw 29 such that the guide plate 27 oscillates around the step screw 29. The screw 29 is positioned at approximately one quarter of the height downward from the top of the guide plate 27.

Thus the amplitude of the guide plate 27 is approximately twice the amplitude of the needle 2, since the distance from the hinge stud 5 to the tip of the needle 2 is approximately one and half times the distance from the hinge stud 5 to the guide block 7.

Thereby establishing the following equations:

$$b/a=1.5 \quad (1)$$

$$2*b=a*y/x \quad (2)$$

Wherein x denotes the distance, from the guide block 26 to the screw 29, y denotes the distance from the screw 29 to button end of the guide plate 27. By solving the above equations (1) and (2), $x/y = \frac{1}{3}$is derived. The guide plate 27 provides two projections 30, 31 at its lower end, and these two projections 30,31 are positioned so as to put the needle drop points therebetween.

According to the embodiment, when the needle bar frame 3 oscillates, the guide plate 27 oscillates around the step screw 29 since the end of the guide plate 27 is pivotally connected tg the guide block 26. Thereby, projections 30, 31 oscillate adjacent to the needle 2, and the amplitude of the projections 30, 31 is twice that of the amplitude of the needle 2. The direction of the oscillation of the projections 30, 31 is opposite to the direction of the oscillation of the needle 2 since the guide plate 27 is pivoted to the fixing plate 28 by the step screw 29.

Figure 2A:
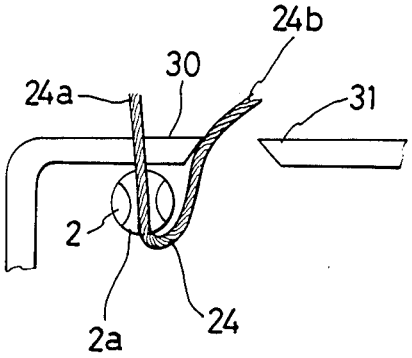
FIGS. 2A and 2B show a needle thread guided by the needle thread guiding apparatus of the present invention.

Referring to FIG. 2A, when the needle 2 oscillates from right side to left side, the projection 30 oscillates from its left side to its right side so that the needle thread portion 24*b* positioned below the needle eye 2*a* is guided by the projection 30.

Figure 2B:
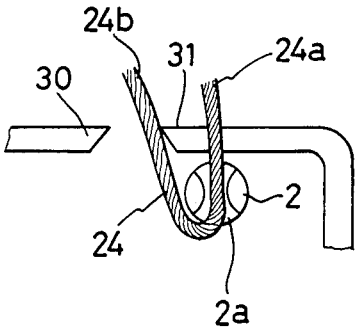

Referring to FIG. 2B, when the needle 2 oscillates from its left side to its right side, the projection 31 oscillates from its right side to its left side so that the needle thread portion 24*b* positioned below the needle eye is guided by the projection 31.

According to the embodiment, the guide plate 27 starts guiding the needle thread 24*b* when the needle bar starts descending from its highest position. Therefore, the needle thread portion 24*b* positioned below the needle eye 2*a* is protected from being stuck by the needle 2.

Figure 3A:
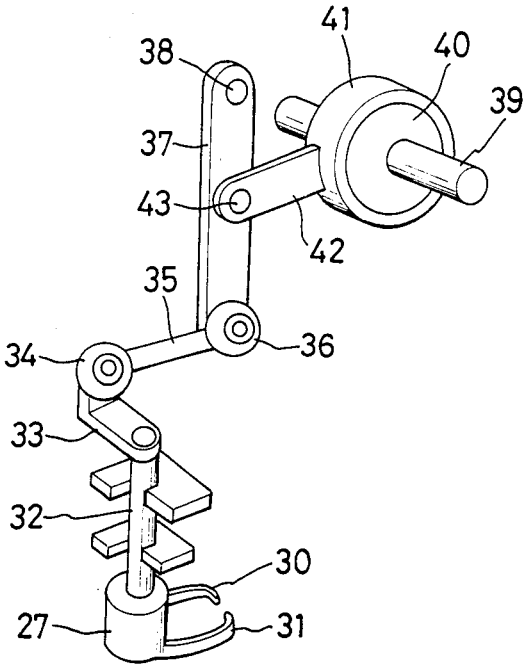
FIG. 3A is a perspective view of a needle thread guiding apparatus according to another embodiment of the present invention.
Figure 3B:
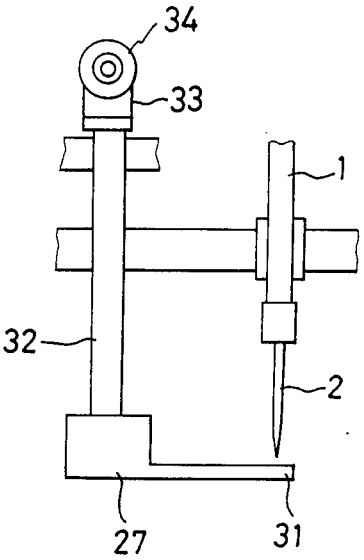
FIG. 3B is a side view of FIG. 3A.
Figure 4:
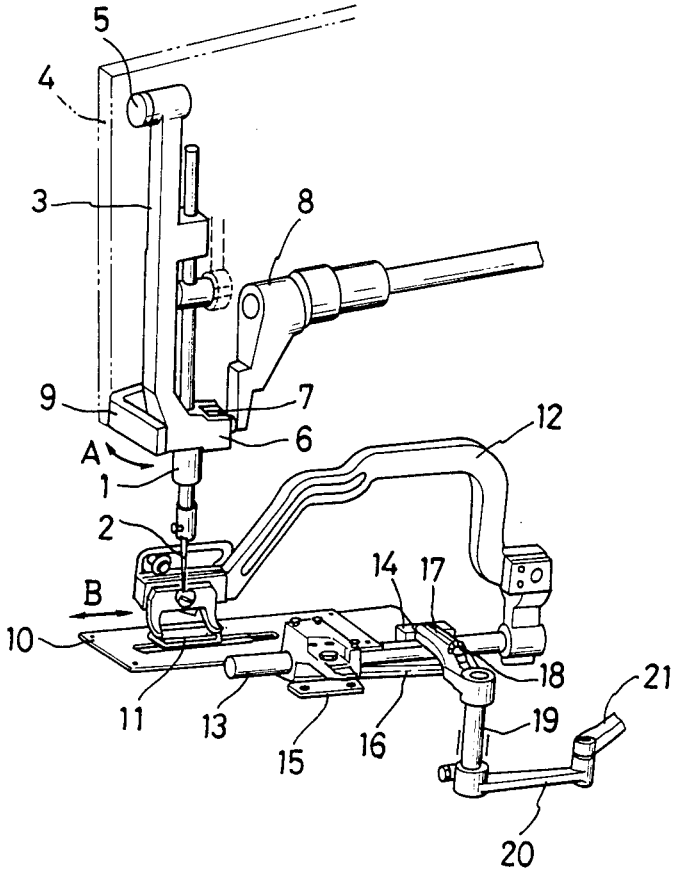
FIG. 4 PRIOR ART
FIG. 4 is a perspective view of a conventional button holing sewing machine.
Figure 5:
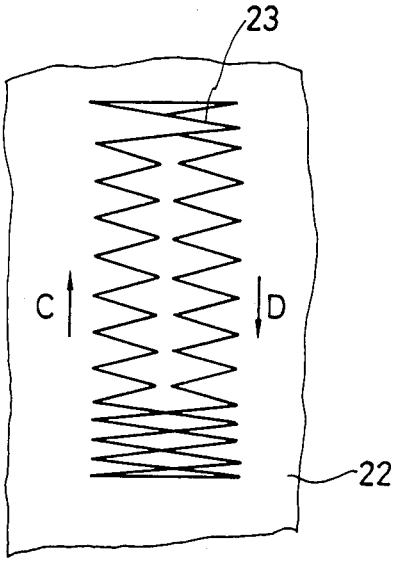
FIG. 5 shows the stitching pattern of a button holing sewing machine.
Figure 6A:
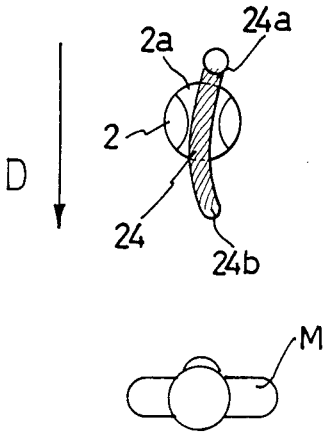
FIGS. 6A and FIG. 6B show the positional relation between the needle thread, the needle eye, and the operator, according to a conventional button holing sewing machine.
Figure 6B:
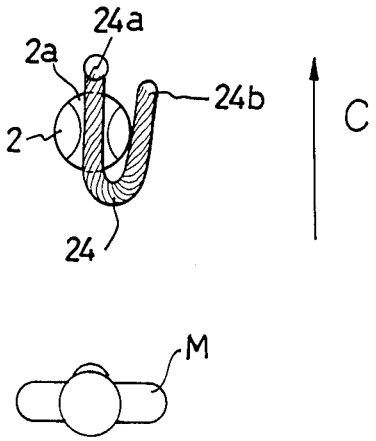
Figure 7:
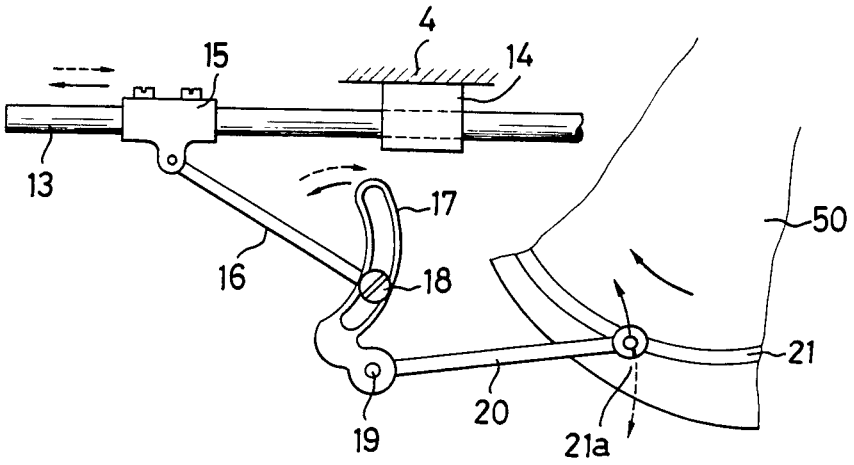
FIG. 7 PRIOR ART
FIG. 7 shows how the workpiece is fed in FIG. 4.
Figure 8A:
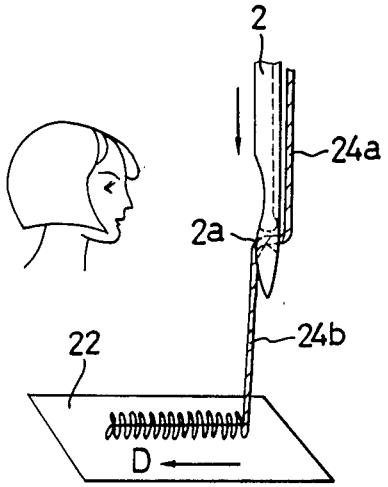
FIG. 8A is a side view of FIG. 6A.
Figure 8B:
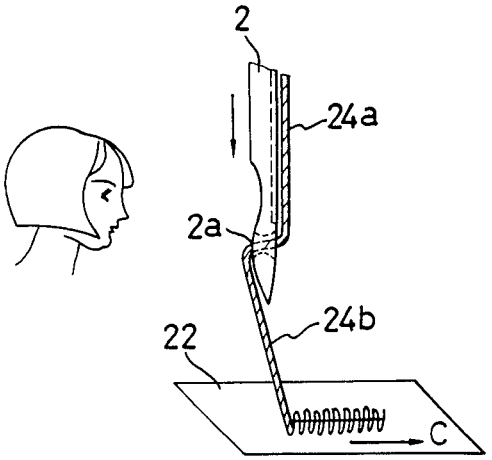
FIG. 8B is a side view of FIG. 6B.

Reference is now made to FIG. 3A and FIG. 3B wherein FIG. 3A shows a perspective view and FIG. 3B shows a side view of another embodiment of the invention.

The guide plate 27 is fixed to a shaft 32. One end of a needle thread guide 33 is fixed to the upper end of the shaft 32. Another end of the needle thread guide 33 is connected to a ball-joint 34. A link 35 is connected to the ball-joint 34 at its one end and another end is connected to another ball joint 36. The ball-joint 36 is connected to the lower end of a rock arm 37.

The upper end of the rock arm 37 is pivotally connected to the frame by a hinge stud 38. An arm 42 extended from a side face 41 of a eccentric cam 40 is pivotably connected to the center portion of the rock arm 37 by a pin 43. The eccentric cam 40 performs eccentric motion by a shaft 39 which is connected to the main shaft (not shown). The positions of the projections 30, 31 in relation to the position of the needle is the same as before. Under the aforementioned construction, when the main shaft completes one rotation, the needle 2 completes one up-down stroke and the guide plate 27 completes one guiding action rightwardly or leftwardly.

Figure 9:
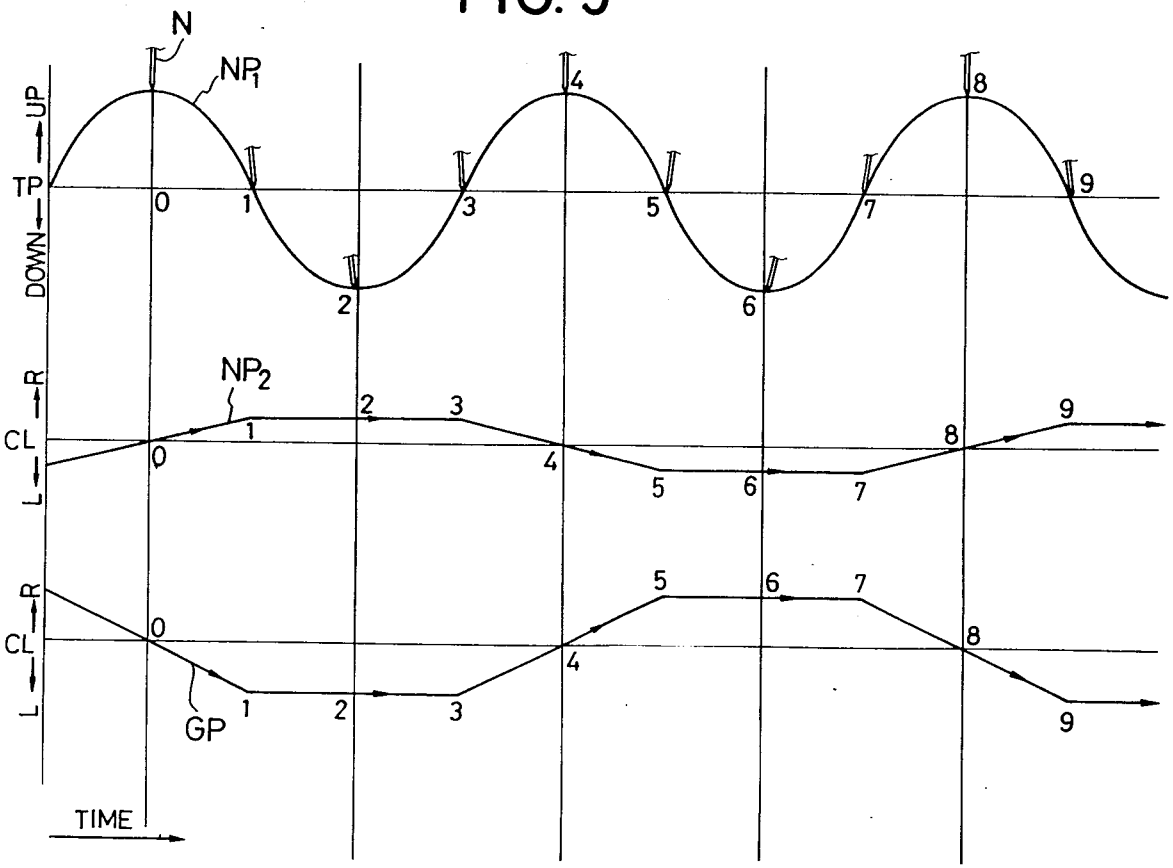
FIG. 9 shows the up-down motion of a needle and the oscillation motion of a needle, and the guiding motion of a guide plate according to the teachings of the present invention.

Reference is made to FIG. 9, in describing the aforementioned relative actions between the up-down motion of the needle 2, the oscillating motion of the needle 2 and the guiding motion of the guiding plate 27.

Curve $NP_1$ indicates the vertical position of the needle "N" in the Y axis and the time in the X axis.

Curve $NP_2$ indicates the amplitude of the needle in the Y axis and the time in the X axis.

Curve GP indicates the amplitude of the guide plate in the Y axis and the time in the X axis.

When the needle "N" descends as shown in curve $NP_1$ from its highest position, the needle starts to oscillate as shown in line, $NP_2$ and simultaneously the guide plate starts to oscillate as shown in line GP and to guide the needle thread, but its direction of guiding is just opposite to the direction of the needle oscillation. The amplitude of the guide plate is approximately twice the amplitude of the needle.

The needle thread guiding action will be conducted when the line GP in FIG. 9 crosses beyond tne center line GL. Therefore, the periods of 01, 45, 89 are guiding periods.

In any event, the needle thread guiding action will be conducted when the needle descends from its highest position until it reaches the throat plate.

It may be realized that with the invention, the guide plate guides the portion of the needle thread positioned below the needle eye when the needle descends, thereby protecting the needle thread from being stuck by the needle, and avoiding the formation of a so-called "baloon". Therefore, the invention is very effective in improvihg stitching quality.

As many apparently widely different embodiments of the invention may be made without departing from the spirit and scope therein, it is to be understood that the invention is not limited to the specific embodiments herein except as defined in the appended claims.

I claim:

1. An apparatus for guiding a needle thread extending between the eye of the needle and the work being sewn when the needle is above the work, comprising:

a needle bar for vertically displacing a needle connected to one end of said needle bar;

means for laterally displacing or oscillating said needle bar and needle;

a guide plate for guiding said needle thread;

means for oscillating said guide plate in a direction opposite to said needle's oscillating direction during the vertical displacement of said needle thereby guiding said needle thread away from said needle.

2. An apparatus according to claim 1 further comprising:

said guide plate oscillating means includs a needle bar frame, said needle bar being secured thereto, wherein said needle bar frame is adapted to receive and impart said oscillating motion to said needle bar, and in turn, to said needle; and said oscillating means further including a guide block connected at one end to said needle bar frame and being pivotally connected at another end to an upper portion of said guide plate, a fixing plate pivotally connected to a middle portion of said guide plate so that said guide plate oscillates in a direction opposite to said needle's direction of oscillation.

3. An apparatus according to claim 2 wherein said fixing plate is pivotally connected at a distance from the top of said guide plate of approximately one quarter of the height of said guide plate so that the amplitude of said guide plate is approximately twice the amplitude of said needle.

4. An apparatus according to claim 3 wherein said fixing plate is pivotally connected to said guide plate by means of a set screw.

5. An apparatus according to claim 1 wherein said guide plate includes two projections for guiding said needle thread away from said needle during its descent.

* * * * *